United States Patent [19]

Chao et al.

[11] 3,954,461

[45] May 4, 1976

[54] PROCESS FOR THE PRODUCTION OF LOW APPARENT DENSITY WATER ATOMIZED STEEL POWDERS

[75] Inventors: Hung-Chi Chao; John H. Gross, both of Monroeville Borough; Robert R. Judd, Washington Township, Westmoreland County; Roger L. Rueckl, Franklin Township, Westmoreland County, all of Pa.

[73] Assignee: United States Steel Corporation, Pittsburgh, Pa.

[22] Filed: Feb. 11, 1974

[21] Appl. No.: 441,609

Related U.S. Application Data

[63] Continuation-in-part of Ser. No. 389,603, Aug. 16, 1973.

[52] U.S. Cl. ..... 75/213; 75/200; 75/222; 75/.5 B; 75/.5 A

[51] Int. Cl.² ..... B22F 1/00

[58] Field of Search ..... 75/200, 213, 222, .5 BA; 148/126

[56] References Cited

UNITED STATES PATENTS

| | | | |
|---|---|---|---|
| 3,325,277 | 6/1967 | Huseby | 75/.5 BA |
| 3,752,712 | 8/1973 | Holcomb | 148/126 |
| 3,832,156 | 8/1974 | Wilson et al. | 148/126 |

OTHER PUBLICATIONS

Jones, Fundamental Principles of Powder Metallurgy, 1960, pp pp. 191.

*Primary Examiner*—Leland A. Sebastian
*Assistant Examiner*—B. Hunt
*Attorney, Agent, or Firm*—Arthur J. Greif

[57] ABSTRACT

The apparent density of molding-grade, water atomized steel powder can be significantly decreased by employing the following prescribed treatment. Coarse particles are removed in order that at least 80% of the initial powders are finer than 80 mesh. The size distribution of the powders is then determined. The powders are then annealed to both reduce the carbon and oxygen contents and soften the particles. The annealed and agglomerated particles are then ground in a disk mill at specified speeds and gap spacings, depending on the size distribution of the initial powders. Apparent densities less than 2.8 gm/cc may be achieved by (a) employing powders with a finer particle size distribution, (b) decreasing the rotational speed of the disks and (c) increasing the mill gap.

4 Claims, 2 Drawing Figures

PROCESS FOR THE PRODUCTION OF LOW APPARENT DENSITY WATER ATOMIZED STEEL POWDERS

This Application is a Continuation-In-Part of Application Serial No. 389,603, filed Aug. 16, 1973.

This invention is directed to an economical method for the production of water atomized steel powders with a low apparent density, and more particularly to a method for decreasing the apparent density of such water atomized particles.

Various methods are now employed for the production of metal powders. Thus, metal powders may be produced by (a) electrolytic deposition, (b) direct reduction of metal oxides, (c) reduction of metal halides, and by (d) atomization with high pressure fluids, e.g. water and inert gases. For the production of molding grade-steel powders in large quantities, metal oxide reduction and water atomization are considerably more economical. Of the latter two methods, steel powders that are water atomized have a generally lower impurity content. Water atomized powders also exhibit better flow rates, i.e. better pressfeeding efficiency and therefore permit higher production rates in the production of powder-metallurgy parts. U.S. Pat. No. 3,325,277 exemplifies such a water-atomization process. Although such a process offers a number of commercial advantages, it is somewhat limited in the range of mechanical properties of powders which can be produced thereby. Thus, the apparent densities of commercially available water atomized steel powders is generally within the range of 2.8 to 3.2 gms/cc.[1] However, when the density of a powder metallurgical part is not critical, it is generally desirable to employ metal powders with a lower apparent density, since the use thereof will be more economical. Thus, for a powder metal part of a given volume, the tonnage required will decrease as the apparent density, i.e. the weight per unit volume, decreases. Additionally, for parts requiring a degree of inherent porosity, (e.g. self-lubricating bearings, filters) low density is a requisite for such applications. For the above reasons, low density metal powders, i.e. with densities less than 2.8 gms/cc. have been employed more extensively, with the result that a major portion of the commercial die set-ups are designed for the use of such low density powders. Thus, while water atomized powders offer a number of advantages, as noted above, many manufacturers have not converted to their use because (a) of the costs required in retooling their dies for the employment of such powders which normally exhibit higher apparent densities, or (b) their lack of porosity precludes their use in many applications.

[1] Apparent density is determined by measuring the weight of powder in a calibrated cup. Since the density can be effected by the mode of packing, this measurement has generally been standardized (ASTM B212-48), i.e. by flowing the powder through a 0.1 inch diameter by 0.125 inch long orifice located one inch above the top surface of a 25 cc cup.

It is therefore a principal object of this invention to provide a method for producing water-atomized steel powders with an apparent density lower than 2.8 gm/cc, and preferably less than 2.6 gm/cc.

Other objects and advantages of the instant process will be more readily understood from the following detailed description, when read in conjunction with the appended claims and drawings, in which:

Figure 1:
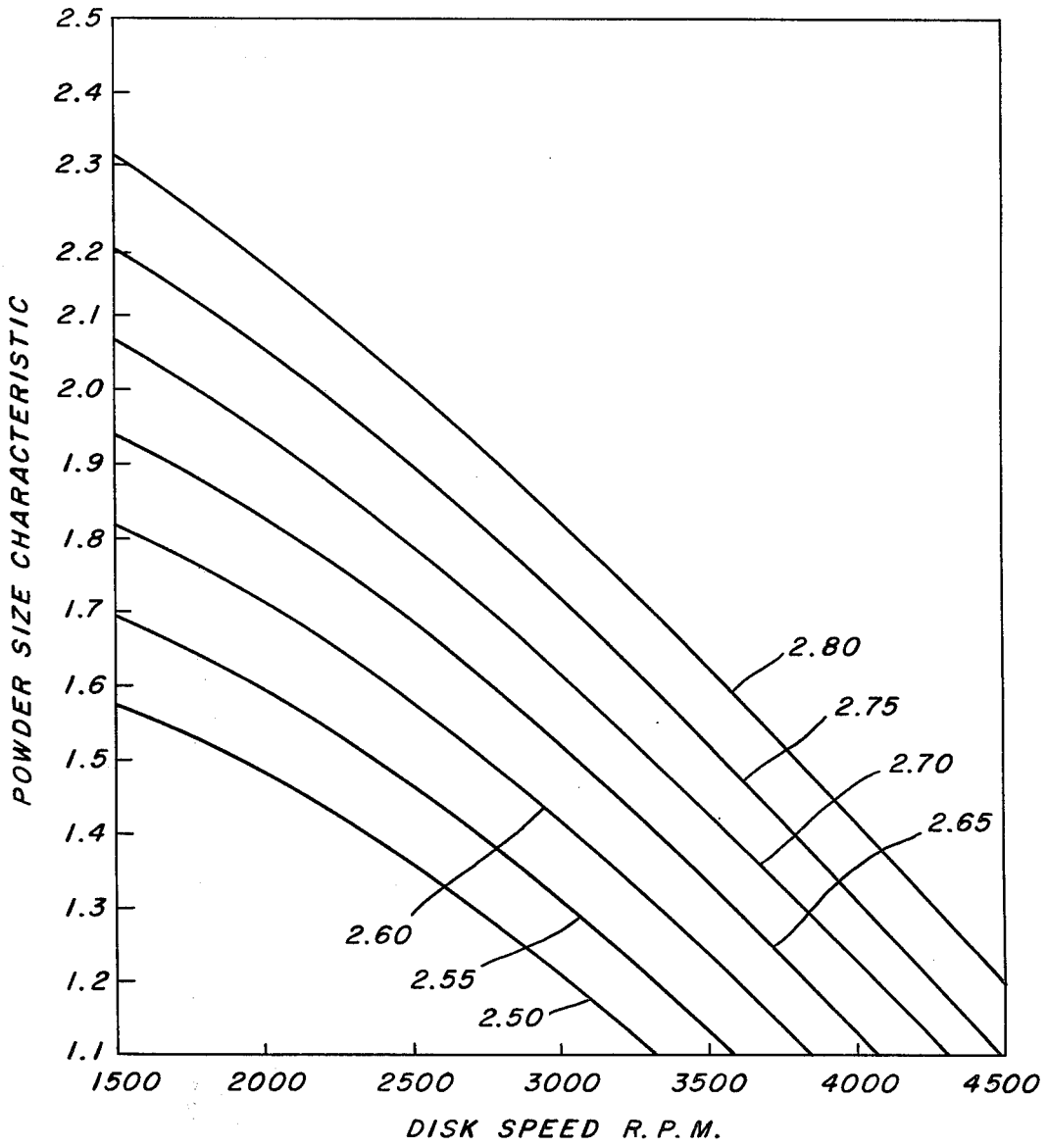
FIG. 1 is a graphical representation showing the effect of particle size distribution, disk speed and a mill-gap of one sixty-fourth inch on apparent density.

The method of this invention is applicable to water-atomized steel powders from virtually any source. Water-atomized steel powders generally contain impurities, primarily in the form of oxides, that must be removed before the powder has commercial value for the production of powder-metallurgical parts. In order to produce steel powders with maximum compressibility, it is also desirable that the final powders have a carbon content below about 0.10%, and preferably below 0.01%. However, it is generally impractical to provide an initial steel melt with such low carbon content. Therefore, such steel melts may contain up to 0.8% C, but preferably less than about 0.15% C, and the carbon content of the atomized powders is thereafter lowered by annealing in a decarburizing-reducing atmosphere. Atomization by high pressure water jets results in rapid quenching of the liquid metal droplets during the early stage of the atomization process. Therefore, even if a relatively low carbon steel were employed (i.e. eliminating the need for decarburization) in the atomization process, it would still be necessary to anneal the powders to effect both softening and lowering the oxygen content thereof (to a value below about 0.2%). The initial oxygen contents of as-water-atomized particles is generally far in excess of 0.2%, generally about 1.0%. As a result of this high surface oxygen content and the particle configuration thereof, the as-atomized particles will pack to a high apparent density, i.e., well in excess of 3.2gm/cc. However, after the requisite annealing and reduction of the oxygen content thereby, the apparent density will normally be within the range of 2.8 to 3.2 gm/cc. Annealing is conducted at temperatures of 1400°F to 2100°F, in a reducing atmosphere such as hydrogen or dissociated ammonia for a time sufficient to effect the desired softening and reduction of impurities. This annealing treatment not only purifies the steel powder, but causes the particles to stick together in the form of a sintered cake, thereby necessitating a breaking up of the cake to return it to powder consistency. In the process of U.S. Pat. No. 3,325,277, this requisite break-up is accomplished in a hammer-mill; employing impact shattering to return the particles to their original as-atomized size. The instant invention departs from this process by performing a true grinding operation in a disk mill; employing a shear mechanism for comminution. It has now been found that by regulation of such a grinding operation, the final apparent density can be tailored to specific requirements, depending on the size distribution of the original as-atomized particles.

The size distribution of the as-atomized powder may be determined by conventional screen analysis. This screen analysis is then employed to develop the particle size characteristics (PSC) of the powder. It has been found that unduly coarse, as-atomized particles cannot be ground to achieve the desired objects of this invention. Thus, to achieve the requisite grinding, it is necessary that at least 80%, and preferably greater than 95%, of the as-atomized particles be finer than 80 mesh (U.S. Series). While a number of different methods are available for defining PSC value, for purposes of this invention, this value is determined in the following manner.

A cumulative weight percentage is first determined of the particles that are retained on U.S. Standard 100-, 140-, 200-, 230-, and 325-mesh screen and the pan fraction. Thereafter, the so-determined cumulative percentages are totalled and divided by 100. Thus, utilizing this definition, as increase in PSC reflects a coarser particle size distribution and a low PSC is indicative of a fine particle size distribution.

For example, the PSC of the following powder would be calculated as follows:

| U.S. Standard Mesh | % Retained | Cumulative % Retained |
|---|---|---|
| 100 | 2.4 | 2.4 |
| 140 | 5.3 | 7.7 |
| 200 | 16.1 | 23.8 |
| 230 | 4.9 | 28.7 |
| 325 | 12.9 | 41.6 |
| Pan | 58.4 | 100.0 |
| | 100.0 | 204.2 |

Therefore, the PSC of this powder would be 204.2/100, or 2.04.

Water atomized particles with PSC values of from about 1.0 to 2.7 may be effectively employed in the instant process. However, since a PSC value below about 1.5 is indicative of a powder in which substantially all the particles are finer than 230 mesh, the use of such fine distributions will generally be impractical because of the small yield resulting from the conventional water atomization process. Therefore, for economic reasons, it is preferable that the powders employed have a PSC value greater than about 1.5. On the other hand, it is preferable to employ powders with a PSC value below about 2.3 to permit the use of practical grinding cycles, and especially in the production of powders with apparent densities of 2.6 gm/cc or less.

Once the PSC is known, and the powder has been annealed, a grinding cycle can be established to tailor the properties to specific requirements. A Disk Attrition Mill is then employed to effect the requisite grinding. As a result of annealing, the particles sinter together in the form of a cake. If necessary, the resultant sinter cake is first broken in pieces small enough, generally less than about one inch, to be fed into the Disk Attrition Mill. In such a mill, grinding occurs between disks, which generally rotate in either a vertical or horizontal plane. The feed enters near the center of the disk, travels by centrifugal force to the peripheral, grinding-plate portion thereof, and is then discharged. While in certain disk mills, spike tooth plates have been employed, it should be understood that such plates are not applicable to the instant invention, which is limited to the use of conventional, friction grinding plates. The mill gap referred to herein, is the distance between the grinding plates. The disk mill is particularly suited for the purpose of this invention since it has been found that such a mill is capable of yielding a controlled and predictable degree of grinding which is basically a function of (a) the mill gap, and (b) the linear speed of a point on medial radius $r_m$, of the grinding plates. In a disk mill, the locus of the grinding plates form a ring, (i.e. two concentric circles); where the distance from the center to the grinding plate, i.e. from the center to inner circle is $r_1$. The distance from the center to the peripheral portion of the grinding plate, i.e. from the center to the outer circle, is $r_2$. Therefore, the medial radius $r_m$ is then $r_1 + r_2/2$. Since linear speed, $v$, is equal to the angular speed ($\omega$) times the radius, the linear speed of a point on the medial radius may easily be determined from the revolutions per minute of the grinding plates. Thus, for example, if grinding plates with a $r_m$ of 12 inches are rotated at 3000 rpm's, the linear speed ($v$) will be:

$$v = \omega r$$

or $$v = 3000 \times 2\pi \times 12 = 72{,}000\ \pi \text{ inches/min.}$$

Through the use of statistical regression and engineering interpretation analysis, the effect of the above variables on the apparent density of the final product powder was found to be described by the equation:

$$\text{Apparent Density (g/cc)} = 2.16 + 0.30\ \text{PSC} - 1.28\ .10^{-5} v + 2.87\ .10^{-2}\ \text{LG} + 1.93\ .10^{-6}\ .\ v\ .\ \text{PSC} + 4.00\ .10^{-11}\ v^2 - 3.96\ .10^{-6}\ .v.\ \text{LG}$$

where PSC is the particle size characteristic of the as-water atomized powder, prior to annealing $v$ is the linear speed of a point on the medial radius of the grinding plates, in inches per minute, and LG is the Log of (mill gap in inches).

Through the use of the above equation, a grinding cycle can therefore be established to tailor the properties of the final product powder to specific requirements. To provide a better understanding of the use thereof, the process equation was employed to develop the graphs of FIGS. 1 and 2, for a laboratory sized disk mill with a 13-inch diameter disk, having a $r_m$ of 5.31 inches. For ease of interpretation, (i.e. the avoidance of highly cumbersome numbers) the linear speed $v$, was converted to the rpm of this disk mill. It should be understood, however, that these graphs are only applicable to a mill with a $r_m$ of 5.31 inches. In commercial practice, a larger diameter disk mill would generally be employed. The curves of FIGS. 1 and 2 would then be shifted to lower rpm values as the size of the mill is increased, since the linear speed $v$ (at any given rpm) would be correspondingly higher. In general, such mills will be operated at speeds of about 200–5000 rpm, with mill gaps ranging from about 0.01 to 0.10 inches.

Figure 2:
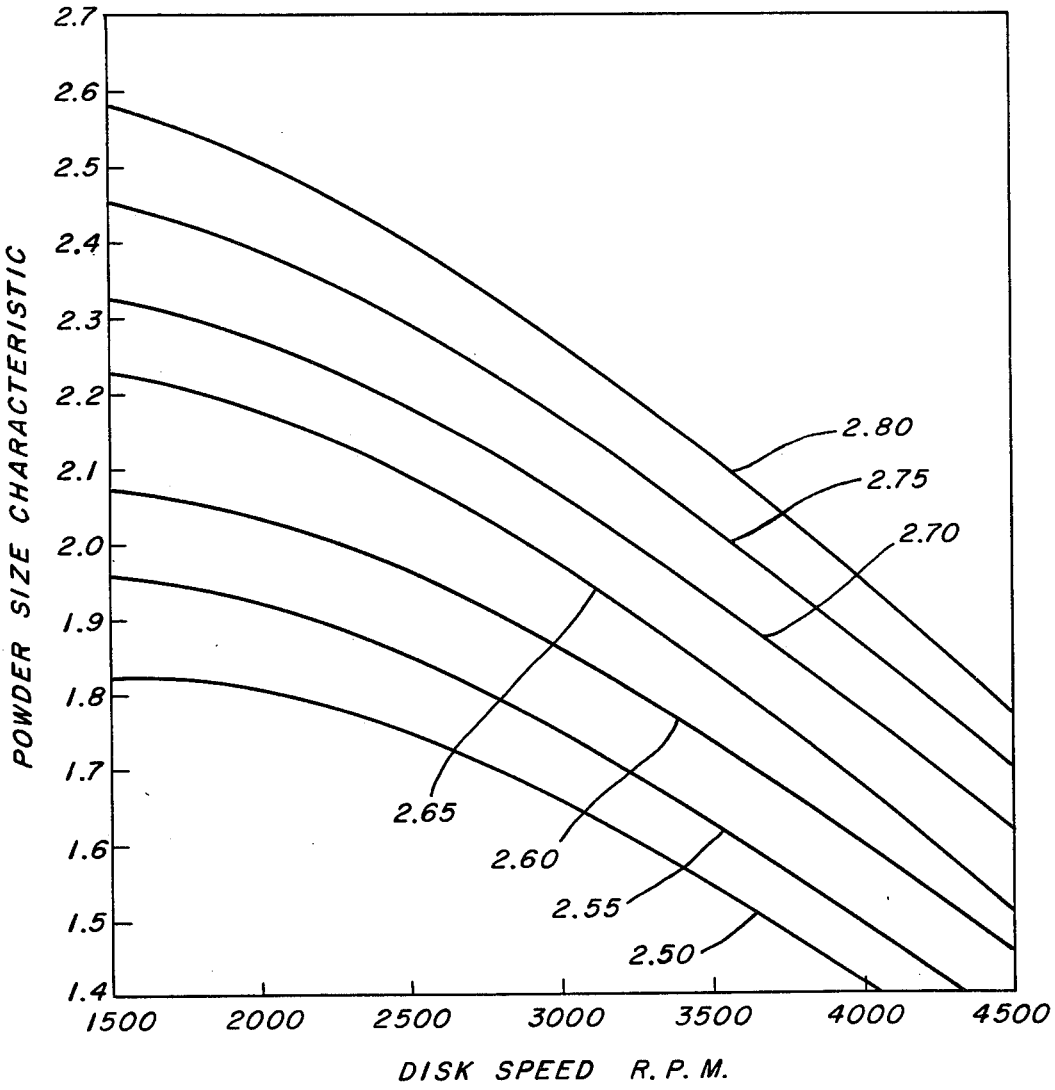
FIG. 2 is a graphical representation showing the effect of particle size distribution, disk speed and a mill-gap of one-sixteenth inch on apparent density.

The utilization of the graphs of FIGS. 1 and 2 will be described for powders exhibiting the following exemplary screen analyses:

| Powder | +100 | +140 | +200 | +230 | +325 | Pan | PSC |
|---|---|---|---|---|---|---|---|
| A | 2.8 | 4.1 | 9.0 | 2.9 | 13.6 | 67.6 | 1.77 |
| B | 4.2 | 8.5 | 17.3 | 6.9 | 17.8 | 45.3 | 2.38 |

If as-atomized powder A were to be employed, and the mill were to be operated at a gap of 1/64 inch (FIG. 1), it may be seen, for example that apparent densities of 2.75 gm/cc and 2.6 gm/cc could be produced by employing speeds of about 2850 rpm and 1750 rpm respectively. The effect of increased mill gap may be seen by comparison with FIG. 2. Utilizing the same powder (A) and the same disk speeds as above, the apparent densities of the resulting powders would have decreased to 2.55 gm/cc and to below 2.5 gm/cc respectively.

Powder B, being inherently coarser, cannot be used, as readily, to produce low apparent density molding grade powder. Utilization of such a coarser powder with a mill gap of 1/64 inch (FIG. 1), a density somewhat below 2.8 gm/cc. can nevertheless be produced at disk speeds below 1200 rpm. However, such coarse powder can more effectively be employed by simultaneously increasing the mill gap, e.g. to 1/16 inch as in FIG. 2. With the latter gap, a density below 2.75 gm/cc would be achieved at speeds of about 2000 rpm.

From the illustrative examples above (or from the process equation itself) it may therefore be seen that apparent density decreases as:

a. the PSC value of the as-atomized particles is decreased, b. the disk speed of the mill is decreased, and c. the mill gap is increased.

It was also found, within the specified temperature range of 1400°–2100°F, that apparent density could also be slightly decreased by increasing the annealing temperature. Therefore, in processes in which the achievement of low apparent densities is of prime concern, it is preferable to employ annealing temperatures at the higher end of the above range, i.e. temperatures of about 1800°–2100°F.

We claim:

1. A method for the production of molding grade steel powders with low apparent densities, which comprises, a. providing as-water-atomized steel particles with a prescribed size distribution, wherein at least 80% of said particles are finer than 80 mesh and said distribution exhibits a PSC value of between 1.0 to 2.7, b. annealing said particles at a temperature within the range of 1400°–2100°F for a time at least sufficient to (i) effect the desired softening thereof, and (ii) reduce the oxygen content thereof to a value below about 0.2 weight percent, said annealing causing said particles to sinter together, c. feeding the annealed, sintered particles to a disk mill operated at a speed of between about 200 to 5000 revolutions per minute and a mill gap of between about 0.01 to 0.10 inches, wherein the linear speed $v$ of said disks is sufficiently low and the mill gap G is sufficiently large to grind said cake to molding grade powders with an apparent density of less than 2.6 gm/cc, substantially all of which are finer than 80 mesh.

2. The method of claim 1, wherein the PSC value of said atomized particles is between about 1.5 and 2.3 and the speed $v$ and mill gap G are correlated with said PSC value in accord with the following equation:

$$+0.30\ \mathrm{PSC} - 1.28.10^{-5}v + 2.87.10^{-2}\ \mathrm{LG} + 1.93 .10^{-6}.v.\ \mathrm{PSC}$$

$$+4.00\ .10^{-11}\ v^2 - 3.96\ .10^{-6}\ .v.\ \mathrm{LG} < 0.44$$

to yield a molding grade powder product with an apparent density below about 2.6 gm/cc.

3. The method of claim 2, wherein at least 95% of said as-water-atomized particles are finer than 80 mesh, with a major portion finer than 200 mesh.

4. The method of claim 3, wherein the carbon content of said as-atomized particles is less than 0.15% and said annealing temperature is greater than about 1800°F.

* * * * *

UNITED STATES PATENT OFFICE

CERTIFICATE OF CORRECTION

Patent No. 3,954,461 Dated May 4, 1976

Inventor(s) Hung-Chi Chao et al.

It is certified that error appears in the above-identified patent and that said Letters Patent are hereby corrected as shown below:

Column 4, lines 20-21,

"$-1.28.10^{-5}v + 2.87.10^{-2}LG+1.93.10^{-6}.v.PSC$
$+4.00.10^{-11}v^2 -3.96.10^{-6}.v.LG$" should be -- $-1.28 \cdot 10^{-5}\underline{v} + 2.87 \cdot 10^{-2}\ \underline{LG} + 1.93 \cdot 10^{-6}$
$\cdot\ \underline{v} \cdot \underline{PSC} + 4.00 \cdot 10^{-11}v^2 - 3.96 \cdot 10^{-6} \cdot \underline{v}$
$\cdot\ \underline{LG}$ --.

Claim 2, after "the following equation:"

" $+0.30\ PSC -1.28.10^{-5}v +2.87.10^{-2}\ LG +1.93$
$.10^{-6}.v.PSC$
$+4.00.10^{-11}v^2 -3.96.10^{-6}.v.LG < 0.44$" should be -- $+0.30\ PSC - 1.28 \cdot 10^{-5}\underline{v} + 2.87 \cdot 10^{-2}\underline{LG}$
$+ 1.93 \cdot 10^{-6} \cdot \underline{v} \cdot PSC + 4.00 \cdot 10^{-11}\ \underline{v}^2$
$- 3.96 \cdot 10^{-6} \cdot \underline{v} \cdot \underline{LG} < 0.44$ --.

Signed and Sealed this

Tenth Day of August 1976

[SEAL]

*Attest:*

RUTH C. MASON
*Attesting Officer*

C. MARSHALL DANN
*Commissioner of Patents and Trademarks*